US010258141B2

(12) United States Patent
Brewer et al.

(10) Patent No.: US 10,258,141 B2
(45) Date of Patent: Apr. 16, 2019

(54) POWER HAIRBRUSH WITH IMPROVED SEBUM-REMOVING BRUSHHEAD

(71) Applicant: L'OREAL, Paris (FR)

(72) Inventors: Gerald K. Brewer, Redmond, WA (US); Akiko Kamigori, Kawasaki (JP)

(73) Assignee: L'Oréal, Paris (FR)

( * ) Notice: Subject to any disclaimer, the term of this patent is extended or adjusted under 35 U.S.C. 154(b) by 267 days.

(21) Appl. No.: 14/955,754

(22) Filed: Dec. 1, 2015

(65) Prior Publication Data

US 2017/0150810 A1 Jun. 1, 2017

(51) Int. Cl.

| | |
|---|---|
| ***A46B 13/02*** | (2006.01) |
| ***A46B 5/00*** | (2006.01) |
| ***A46B 9/02*** | (2006.01) |
| ***A46B 13/00*** | (2006.01) |
| ***A46D 1/00*** | (2006.01) |
| ***A46B 9/06*** | (2006.01) |

(52) U.S. Cl.

CPC ..... *A46B 13/02* (2013.01); *A46B 5/0095* (2013.01); *A46B 9/023* (2013.01); *A46B 9/06* (2013.01); *A46B 13/008* (2013.01); *A46D 1/0207* (2013.01)

(58) Field of Classification Search

CPC ..... A46B 9/023; A46B 9/025; A46B 13/008; A46B 13/02; A46B 13/023; A46B 13/026; A46B 13/04; A46B 13/06

See application file for complete search history.

(56) References Cited

U.S. PATENT DOCUMENTS

2005/0040693 A1* 2/2005 Montoli ..... A46B 9/021 300/21

2014/0309662 A1* 10/2014 Brewer ..... A45D 34/042 606/131

FOREIGN PATENT DOCUMENTS

JP H1146865 A * 2/1999 ..... A46B 9/02

* cited by examiner

*Primary Examiner* — Shay Karls

(74) *Attorney, Agent, or Firm* — Clark A. Puntigam; Jensen & Puntigam, P.S.

(57) ABSTRACT

A power hairbrush which oscillates in operation with a frequency in the range of 55 Hz-120 Hz and an amplitude in the range of 8-20°, with a brushhead adapted to remove sebum and other material from the scalp and hair of a user, the brushhead including a plurality of lines or rows of filament tufts, wherein each filament in the filament tufts at its distal end is split into several portions. The brushhead further includes a plurality of lines of solid tuft members positioned adjacent to the lines of filament tufts. The filament tufts are approximately 1-3 mm taller than the solid tuft members.

20 Claims, 7 Drawing Sheets

POWER HAIRBRUSH WITH IMPROVED SEBUM-REMOVING BRUSHHEAD

TECHNICAL FIELD

This invention relates generally to power hair brushes, and more specifically concerns such a hairbrush with a motorized handle with a removable brushhead which is arranged to produce improved sebum removal from the scalp and hair, as well as dandruff, dust, pollution material, hair styling material and other foreign material, while promoting hair alignment, detangling and scalp massage

BACKGROUND OF THE INVENTION

A typical manual hairbrush is designed to brush the hair and, in some cases, depending upon the arrangement of the bristles, provide a massaging effect for the scalp. However, they are typically not very effective in cleaning the hair, nor are they effective in cleaning/removing scalp sebum or other material such as dandruff, dust, pollution material, hair styling material or other foreign material. Accordingly, it is desirable to have a hairbrush which is capable of cleansing the hair and providing care for the scalp, while avoiding tangling of the hair.

SUMMARY OF THE INVENTION

Accordingly, the present invention is a hairbrush with a brushhead for cleaning scalp and hair, comprising: a handle with a motor with a drive shaft which in operation oscillates through an angle in the range of 8-20°, at a frequency in the range of 55 Hz-120 Hz; and a brushhead removably fittable to the drive shaft of the angle, the brushhead having a plurality of lines of separate filament tufts, extending radially of the brushhead toward a peripheral edge of the brushhead, wherein each filament in the tuft is split at a distal end into several portions, the brushhead further including a plurality of lines of solid tufts, extending adjacent to the lines of filament tufts, wherein the filament tufts are taller that the solid tufts.

The present invention also includes a brushhead for use with and removably fittable to a hairbrush for cleaning of the scalp and hair, wherein the hairbrush in operation oscillates back and forth at a selected frequency and amplitude, the brushhead comprising: a brushhead base assembly; a plurality of spaced lines of filament tufts extending radially of the base assembly to near a peripheral edge thereof, wherein each filament tuft is split at a distal end into several separate portions; and a plurality of lines of sold tufts extending adjacent to the lines of filament tufts, wherein the filament tufts are taller than the solid tufts.

BEST MODE FOR CARRYING OUT THE INVENTION

Figure 1:
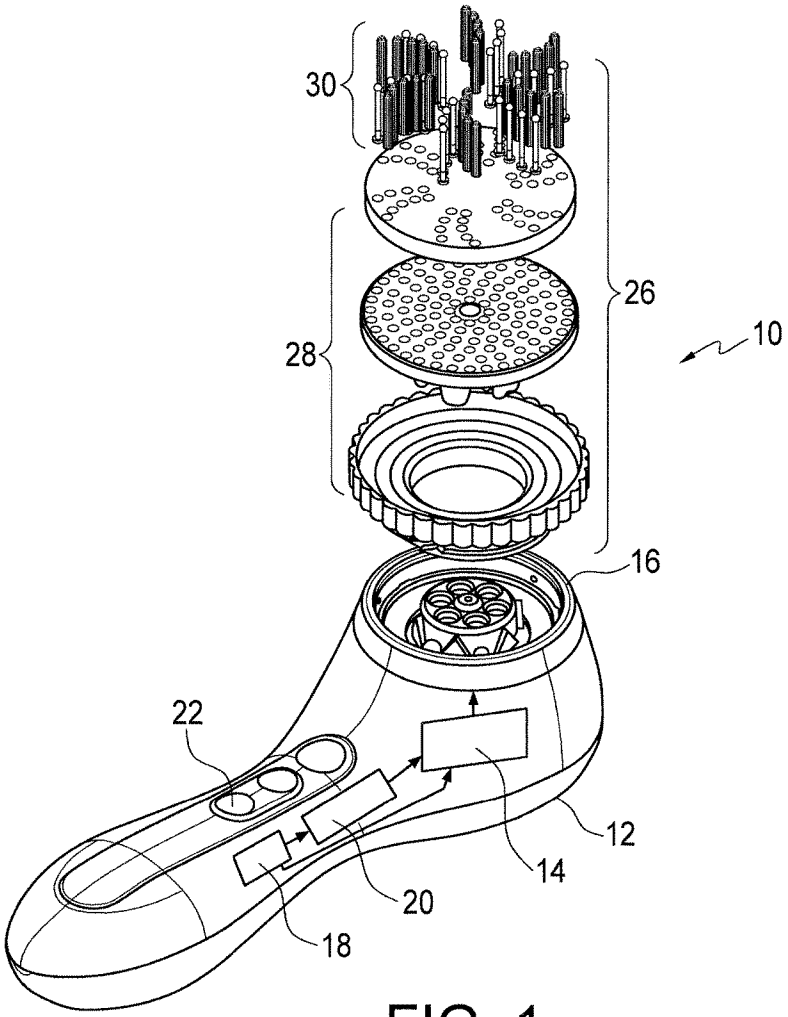
FIG. 1 is an exploded view showing the power hairbrush of the present invention, with one brushhead embodiment exploded therefrom.

The power hairbrush 10 of the present invention includes a handle 12 with a motor 14, oscillating a drive member 16. The motor is driven by a rechargeable battery 18. The operation of the handle is controlled by a microprocessor 20 and an on/off switch 22. The handle 12 is shown generally and its arrangement and configuration can be varied. Removably attached to the handle 12 is a scalp brushhead 26, shown exploded. Brushhead 26 includes a base assembly 28, which is removably attached to the handle 12 and to which is mounted a bristle arrangement 30. The bristle arrangement of the brushhead is configured and designed to provide several specific benefits, including cleansing of the scalp and hair, removal of sebum and other material from the scalp, detangling hair and massaging the scalp. The bristles and their arrangement also act to prevent plugging of the follicles of the scalp.

Figure 2:
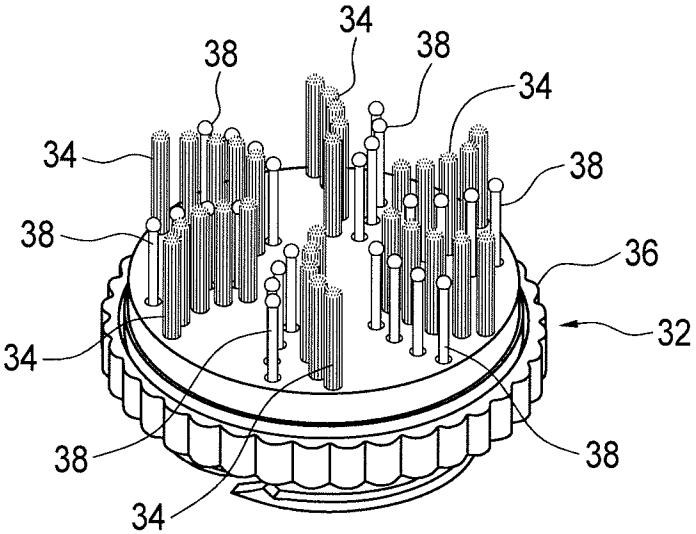
FIG. 2 is a perspective view of the embodiment of the brushhead in FIG. 1.

FIG. 2 shows one embodiment of the brushhead. This embodiment includes a base assembly 32, a plurality of rows or lines of filament tufts, shown generally at 34, which extend in a radial direction on the base assembly, from an interior point near the center of the brushhead to near the peripheral edge 36 thereof. A filament tuft contains one or more filaments. In this embodiment, there are six lines of filament tufts, with each line including five separate filament tufts, although this can vary. Further, each line of tufts is slightly curved. Adjacent each line of filament tufts 34 is a line of single solid tuft members 38. In FIG. 2, the solid tuft members are a polymer (e.g. Nylon or polyimide posts with epoxy tips). Each line of single solid tuft members in the embodiment shown is also slightly curved, matching the curve of the filament tufts 34. Although in the embodiment shown, there are four solid tuft members per line, this number again can be varied. The preferred brush arrangement has a moving base assembly diameter of between 1.75 and 2.5 inches, preferably 2.1 inches. The total tuft density for all types of tufts is 13-23 tufts per square inch. The preferred tuft density is approximately 16 tufts per square inch.

Figure 6:
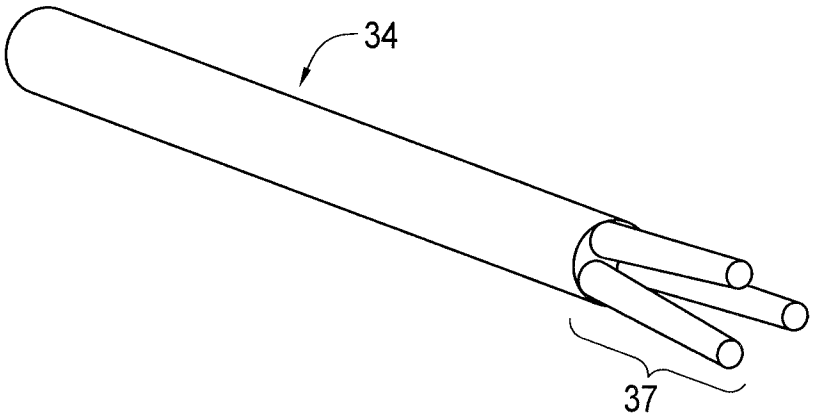
FIG. 6 is a perspective view of a filament portion of the brushheads disclosed herein.

In the embodiment shown, the individual filaments are tapered at the tips thereof and further are split into a plurality of individual portions, preferably three, at the distal end of the filament. The split portions 37, as shown most clearly in FIG. 6, are approximately 1 mm-3 mm in length. It is important that the filaments are somewhat taller than the solid tuft members 38. The difference in length of filaments and the solid tufts should be 1 mm-3 mm, with 2 mm being preferred.

In the embodiment shown, the filament tufts 34 are made from a polymer material or blend, including (Nylon), polyester, silicone or cellulose, (PBT), and (TPE), for example, while the solid tufts may be made from various materials, including polyimide, polyester, poly propylene, TPE or silicone elastomer. The filaments have a diameter ranging from 0.007 to 0.011 inches, preferably 0.009 inches (0.22 mm) and a height in the range of 13-17 mm. The solid tufts have a diameter in the range of 1.4 mm to 1.8 mm, and are usually molded with a taper over their length and may also include a ball of the same or different material, e.g. epoxy, at the tips thereof. The number of filaments and the length of the filaments are selected to provide efficient flex and tip velocity suitable for sebum removal without damaging the protective layers of the scalp, including the stratum conneum and the hair follicles. The filament tips may be finished in a variety of ways that will provide different amounts of exfoliation of the scalp, such as flat cut, rounded or polished to remove sharp edges. They can be tapered, flagged, feathered or split. The preferred embodiment is a feathered filament with three tapered tip portions. Each tapered tip is smaller and more flexible than the original filament which provides each filament with sufficient individual stiffness, that when presented as a plurality of filaments (i.e. tuft) in a brushhead arrangement, it can be forceful enough to penetrate through the hair and allow the soft tips to gently cleanse the scalp and remove sebum and other material from the scalp and the hair.

The brushhead in the embodiment shown is oscillated by the handle at a frequency in the range of 55 Hz to 120 Hz, with a brush base amplitude of 8-20° peak-to-peak. A preferred arrangement is 85 Hz and 14° peak-to-peak.

This arrangement has the advantage of assisting in removing sebum and other material from the scalp, while avoiding plugging of the follicles, as well as removing sebum and other material from the scalp hair. In addition, the arrangement has the capability of the solid tufts 38 reaching the scalp for a massaging effect, when enough force is applied to the brush to make the taller filaments tufts flex enough.

Figure 3B:
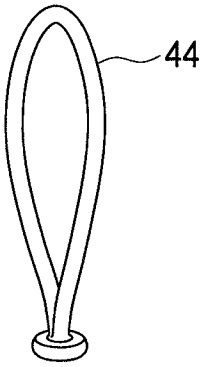
FIG. 3B is a perspective view of a portion of the embodiment of FIG. 3A.
Figure 3A:
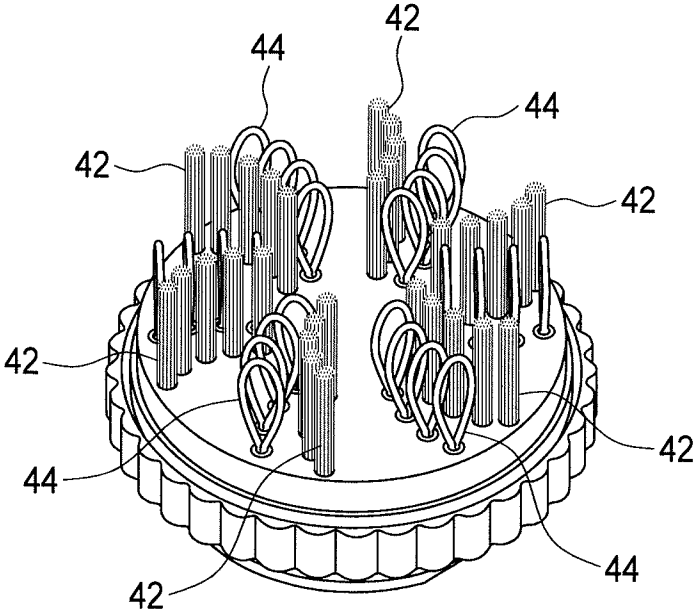
FIG. 3A is a perspective view of another embodiment of the brushhead of the present invention.
Figure 3C:
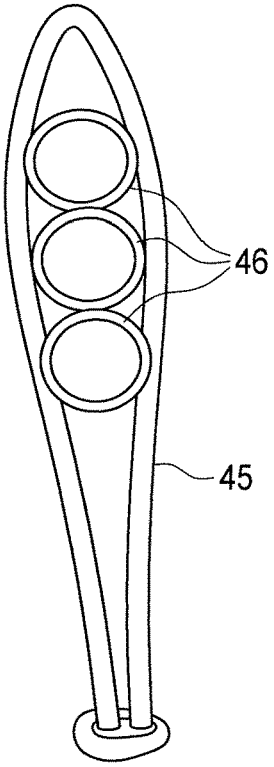
FIG. 3C is a perspective view of a variation of the embodiment of FIG. 3B.
Figure 3D:
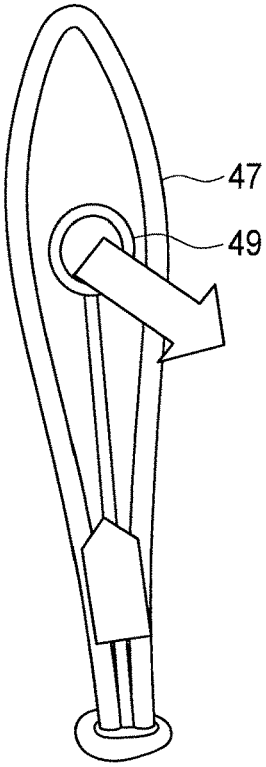
FIG. 3D is a perspective view of a variation of the embodiment of FIG. 3B.
Figure 3E:
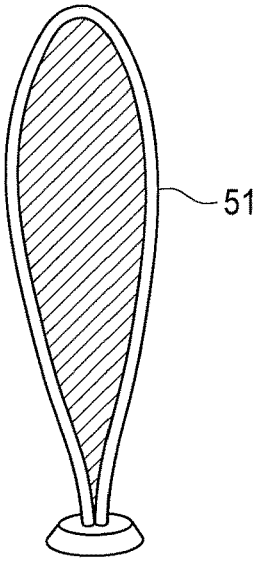
FIG. 3E is a perspective view of another variation of the embodiment of FIG. 3B.

FIGS. 3A and 3B show an alternative arrangement, which includes a plurality of lines of filament tufts with split ends 42 identical to that of FIG. 2, but instead of single solid tufts the arrangement includes lines of loop members 44. The loop configuration is shown in detail in FIG. 3B. The loop 44 will have a diameter of 0.022 inches to 0.04 inches, preferably 0.032 inches, and is shorter that its adjacent filament tufts by the same 1 mm to 3 mm with 2 mm preferred. The loop members produce a somewhat different feeling on the scalp than the arrangement with the single solid tufts. The shape of the loops 44 provide an opportunity to change or otherwise tune the amount of dynamic inertia from tuft bending from the sonic motion/oscillation provided by the handle by rotating the loop direction. In one embodiment, the loops open toward the axial radius and are more tangential to the direction of oscillating motion, while in another embodiment, the loop openings are more in the direction of oscillation, producing more bristle tip motion. In the embodiment shown, the loop has an opening from 0.1 inches to 0.15 inches with 0.12 inches preferred at its widest point, near the middle, with the top and lower ends thereof gradually narrowing to points. The loop may be shaped additionally to optimize the foaming agent or shampoo or other foaming formulations. FIGS. 3C-3E show other loop embodiments. FIG. 3C is like a bubble wand with an outer loop member 45 and one or more inner loops 46-46, of various shapes. Another wand embodiment is shown in 3D, with an outer loop 47 and an inner bubble member 49. FIG. 3E shows a solid paddle embodiment 51. The solid paddle may be used alone as a loop element or it can be used as an out-of-phase member with an open loop member to force fluid through an open loop wand member to create more foaming and/or increased fluid flow. In each case, however, the filament tufts are 1-3 mm taller than the loop members.

Figure 4:
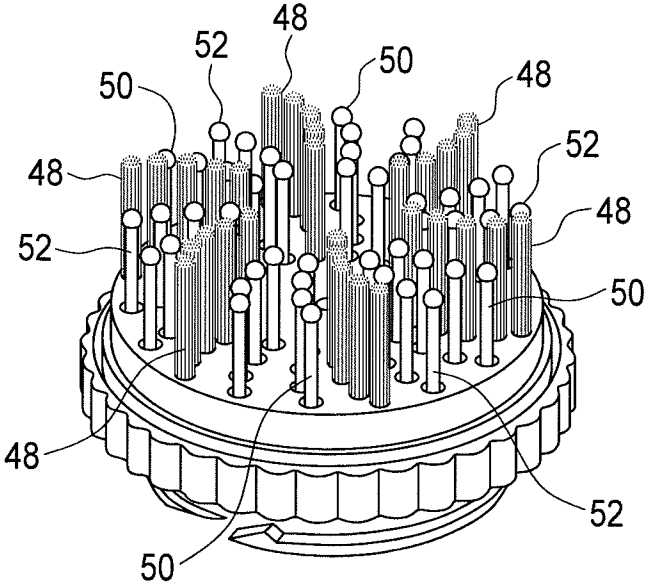
FIG. 4 is a variation of the brushhead embodiment of FIG. 2.

FIG. 4 shows a brushhead illustrating another embodiment, a variation of the brushhead of FIG. 2. In this embodiment, a row of filaments 48, with feathered split distal ends, is bounded by rows of solid tufts 50, 52 adjacent opposing sides of the filaments. The configuration of the filaments and the solid tufts are as described in the above embodiment. It should be understood that loop members could be substituted for solid tufts 50 and 52.

Figure 5:
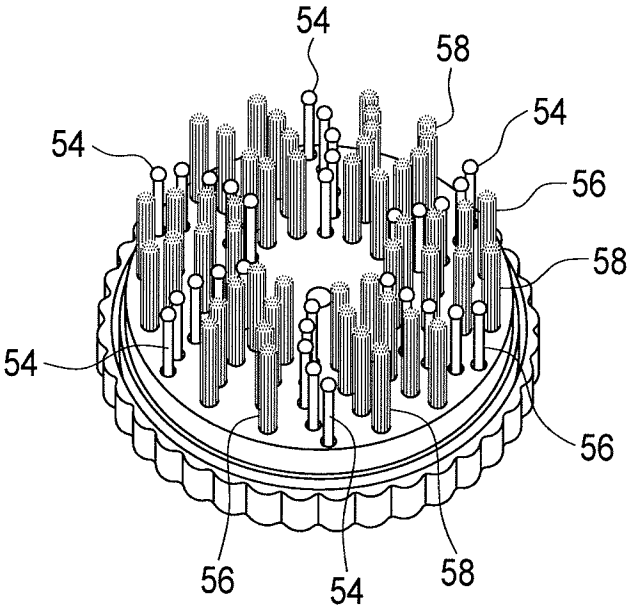
FIG. 5 is another variation of the brushhead embodiment of FIG. 2.

FIG. 5 shows another embodiment, which is another variation of the brushhead of FIG. 2. In this embodiment, each row of solid tufts 54 is bounded by rows of filament tufts 56. The dimensions of the filament tufts and the solid tufts are the same as for the embodiment of FIG. 2. Also, loops could be substituted for the solid tufts to provide a further variation.

The brushhead embodiments disclosed herein have the capability of conveniently and safely removing sebum and other material/contaminants such as pollution particles or other hair treatment particles from the scalp and the hair, preventing clogging of the hair follicles. Further, the elements of the brushhead, namely the individual split filaments and the solid post or loop members, produce a pleasant massaging effect on the scalp, in addition to the cleansing effect.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A hairbrush with a brushhead for cleaning scalp and hair, comprising:

a handle with a motor with a drive shaft which in operation oscillates through an angle in the range of 8-20°, at a frequency in the range of 55 Hz-120 Hz.

a brushhead removably fittable to the drive shaft of the handle, the brushhead having a plurality of pairs of lines or rows of separate bristle filament tufts and lines or rows of separate solid elastomeric tufts, extending radially of the brushhead toward a peripheral edge of the brushhead, wherein the filament tufts are taller than the solid tufts; and wherein the distance between successive pairs of filament tufts and solid tufts is greater than the distance between the filament tufts and the solid tufts in each pair of filament tufts and solid tufts.

2. The hairbrush of claim 1 wherein each filament in the filament tufts is split into three portions at its distal end.

3. The hairbrush of claim 1, wherein the brushhead includes six spaced lines of filament tufts with five filament tufts in each line, and six spaced lines of solid tufts, with five solid tufts in each line.

4. The hairbrush of claim 1, wherein the lines of filament tufts are evenly spaced around the brushhead.

5. The hairbrush of claim 1, wherein the line of filament tufts and the lines of solid tufts are curved.

6. The hairbrush of claim 1, wherein the solid tufts are post elements.

7. The hairbrush of claim 1, wherein the solid tufts are in the form of loops.

8. The hairbrush of claim 1, wherein the filament tufts have a height in the range of 13-17 mm, and wherein the solid tufts have a height of 1-3 mm shorter than the filament tufts.

9. The hairbrush of claim 8, wherein the filament tufts have a diameter in the range of 0.175-0.27 mm and the solid tufts have a diameter in the range of 1.5-1.8 mm.

10. The hairbrush of claim 1, wherein each line of filament tufts comprises a polymer material and the solid tufts are polyimide, polyester, poly-propylene, TPE or silicone elastamers.

11. The hairbrush of claim 1, wherein each line of filament tufts is bounded by lines of solid tufts on each side thereof.

12. The hairbrush of claim 1, wherein each line of solid tufts is bounded by lines of filament tufts on each side thereof.

13. A brushhead for use with and removably fittable to a hairbrush handle, the brushhead comprising:

a brush base assembly;

a plurality of pairs of lines or rows of bristle filament tufts and lines or rows of solid elastomeric tufts, extending radially of the base assembly to near a peripheral edge thereof; and wherein the filament tufts are taller than the solid tufts and wherein the distance between successive pairs of filament tufts and solid tufts is greater than the distance between the filament tufts and the solid tufts in each pair of filament tufts and solid tufts.

14. The brushhead of claim 13, wherein each filament tuft is split at a distal end into several separate portions.

15. The brushhead of claim 13, wherein the filament tufts are in the range of one to three mm taller than the solid tufts.

16. The brushhead of claim 13, wherein the solid tufts are post elements.

17. The brushhead of claim 13, wherein the solid tufts are in the form of a loop.

18. The brushhead of claim 13, wherein the lines of filament tufts and the lines of solid tufts are both curved.

19. The hairbrush of claim 13, wherein each line of filament tufts is bounded by lines of solid tufts on each side thereof.

20. The hairbrush of claim 13, wherein each line of solid tufts is bounded by filament tufts on each side thereof.

* * * * *